US006497348B2

(12) United States Patent
Forsman et al.

(10) Patent No.: US 6,497,348 B2
(45) Date of Patent: Dec. 24, 2002

(54) HYDRATION SYSTEM WITH IMPROVED FLUID DELIVERY SYSTEM

(75) Inventors: Barley A. Forsman, Cotati, CA (US); Robert Choi, Rohnert Park, CA (US)

(73) Assignee: CamelBak Products, Inc., Petaluma, CA (US)

( * ) Notice: Subject to any disclaimer, the term of this patent is extended or adjusted under 35 U.S.C. 154(b) by 0 days.

(21) Appl. No.: 09/902,792

(22) Filed: Jul. 10, 2001

(65) Prior Publication Data

US 2002/0074369 A1 Jun. 20, 2002

Related U.S. Application Data

(60) Provisional application No. 60/217,124, filed on Jul. 10, 2000.

(51) Int. Cl.[7] ..... A47F 3/16

(52) U.S. Cl. ..... 224/148.2; 224/148.5; 224/627; 224/652; 224/660; 224/680; 222/105; 222/212; 222/531

(58) Field of Search ..... 224/148.2, 148.4, 224/148.5, 627, 643, 660, 662, 676, 680, 682; 220/705, 714, 718; 215/11.4, 388; 222/105, 212, 215, 501, 531, 537, 548, 549, 554, 555

(56) References Cited

U.S. PATENT DOCUMENTS

| | | | | |
|---|---|---|---|---|
| 274,447 | A | | 3/1883 | Kennish |
| 1,326,966 | A | | 1/1920 | Reeves |
| 1,637,635 | A | | 8/1927 | Corley |
| 2,013,358 | A | | 9/1935 | Osborne |
| 2,380,372 | A | | 7/1945 | Alderfer |
| 2,684,787 | A | | 7/1954 | Charpiat |
| 2,738,907 | A | | 3/1956 | Lacher |
| 2,802,608 | A | | 8/1957 | Gassaway |
| 3,819,151 | A | | 6/1974 | Kish |
| 3,822,720 | A | | 7/1974 | Souza |
| 4,139,130 | A | | 2/1979 | Glusker et al. |
| 4,189,075 | A | | 2/1980 | Hall |
| 4,193,518 | A | | 3/1980 | Holmes |
| 4,420,097 | A | | 12/1983 | Motsenbocker |
| 4,526,298 | A | | 7/1985 | Boxer et al. |
| 4,629,098 | A | | 12/1986 | Eger |
| 4,739,905 | A | | 4/1988 | Nelson |
| 5,060,833 | A | | 10/1991 | Edison et al. |
| 5,062,591 | A | | 11/1991 | Runkel |
| 5,085,349 | A | | 2/1992 | Fawcett |
| 5,115,947 | A | | 5/1992 | McDonnell |
| 5,358,142 | A | | 10/1994 | Holmes |
| 5,400,934 | A | | 3/1995 | Ducros |
| 5,427,290 | A | | 6/1995 | Thatcher |
| 5,431,308 | A | | 7/1995 | Tchen |
| 5,595,325 | A | | 1/1997 | Leres |
| 5,645,404 | A | * | 7/1997 | Zelenak ..... 222/175 |
| 5,722,573 | A | | 3/1998 | Carnel |
| 5,755,368 | A | | 5/1998 | Bekkedahl |
| 5,803,333 | A | * | 9/1998 | Fawcett ..... 224/148.2 |
| 5,806,726 | A | | 9/1998 | Ho |
| 5,816,457 | A | | 10/1998 | Croft |
| 5,940,880 | A | | 8/1999 | Phillips |
| 5,948,364 | A | * | 9/1999 | Niermann et al. ..... 222/507 |
| 6,062,435 | A | | 5/2000 | Hess, III |
| 6,085,947 | A | | 7/2000 | Lien |
| 6,220,490 | B1 | | 4/2001 | O'Hara |
| 6,247,619 | B1 | * | 6/2001 | Gill et al. ..... 222/105 |

FOREIGN PATENT DOCUMENTS

| | | |
|---|---|---|
| GB | 2249775 | 5/1992 |

* cited by examiner

*Primary Examiner*—Stephan K. Cronin
(74) *Attorney, Agent, or Firm*—Kolisch, Hartwell, Dickinson, McCormack & Heuser, PC

(57) ABSTRACT

A personal hydration system with a flow-restricting device. The hydration system includes a fluid reservoir configured to store fluid and a tube assembly that is coupled to the reservoir and configured to deliver fluid to a user's mouth, such as via a mouthpiece. The system further includes a flow-restricting device that is configured to selectively restrict the flow of drink fluid between the reservoir and the mouthpiece. In some embodiments, the flow-restricting device includes a body and a rotatable core.

42 Claims, 8 Drawing Sheets

FIG. 8
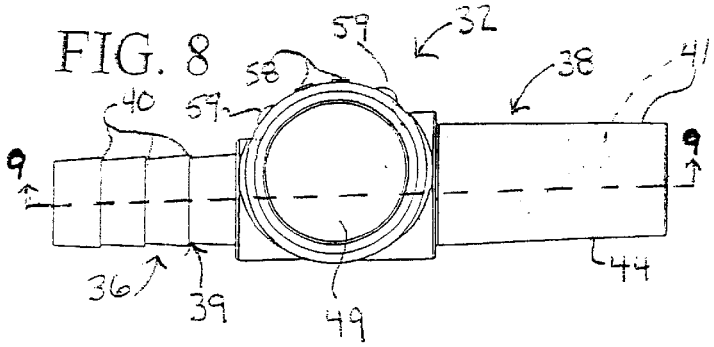
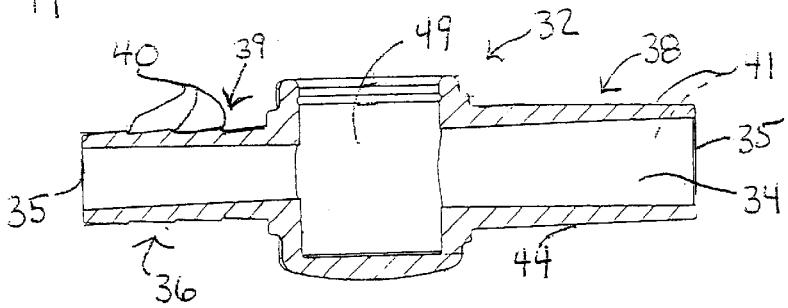
FIG. 9
FIG. 10
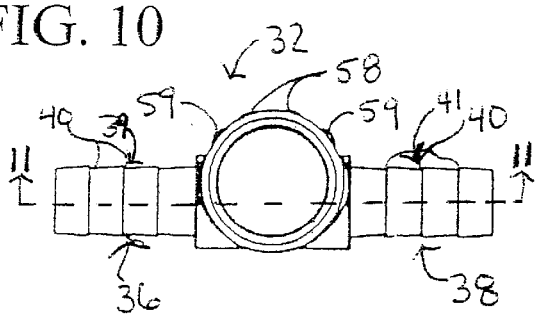
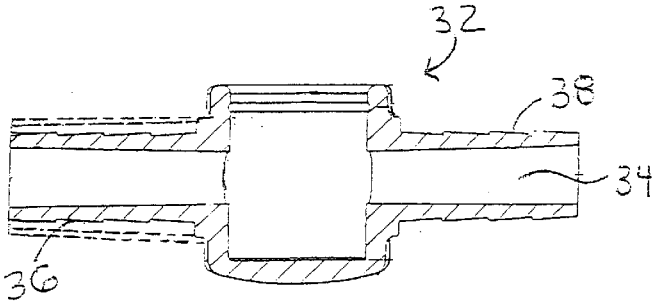
FIG. 11

FIG. 12
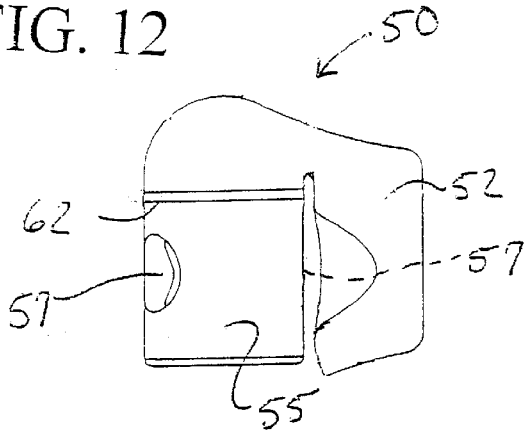
FIG. 13
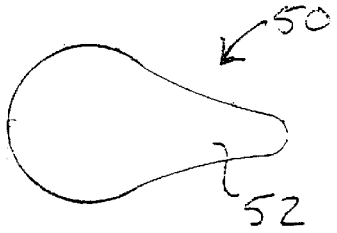
FIG. 14
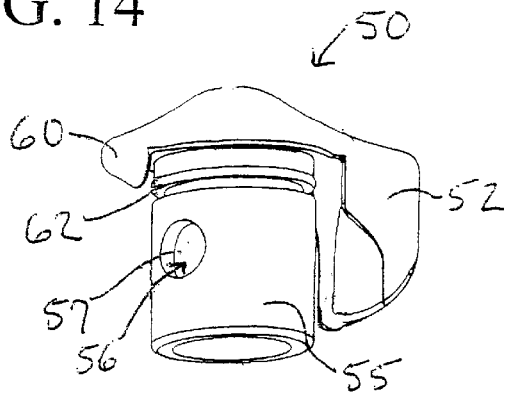
FIG. 15
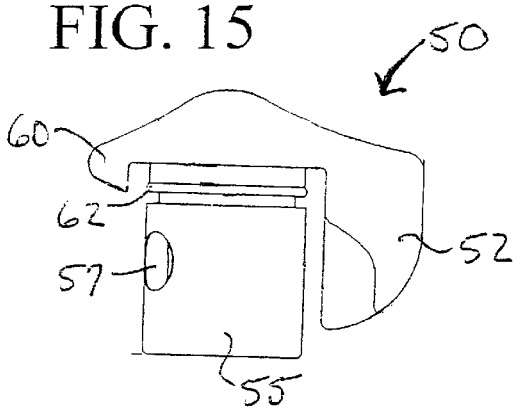
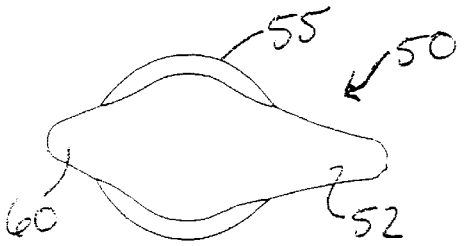
FIG. 16

FIG. 24
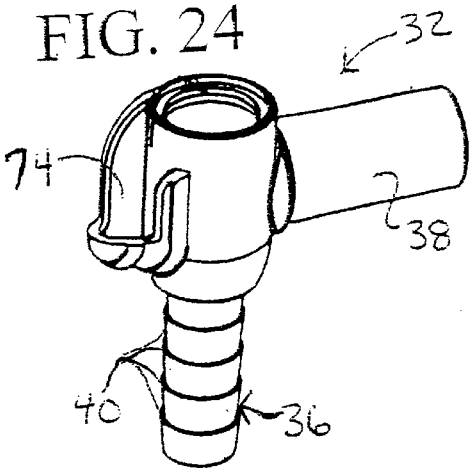
FIG. 25
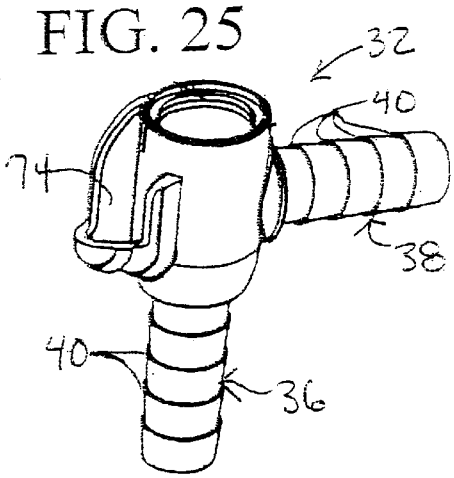
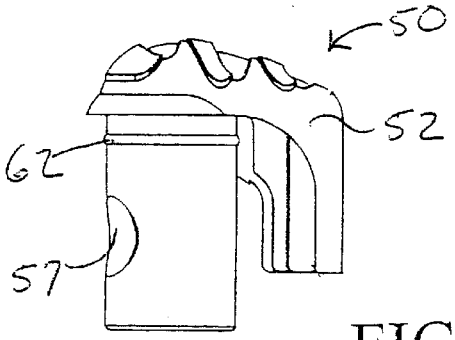
FIG. 26
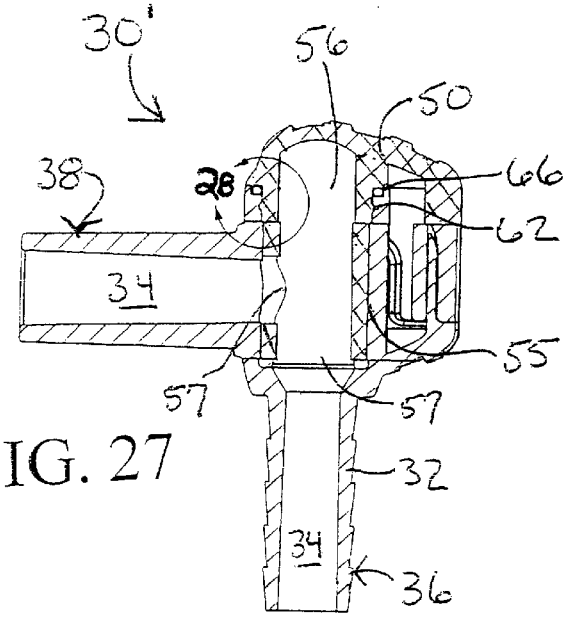
FIG. 27
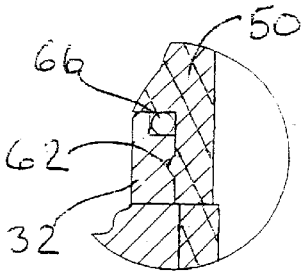
FIG. 28

HYDRATION SYSTEM WITH IMPROVED FLUID DELIVERY SYSTEM

RELATED APPLICATION

This application claims priority to U.S. Provisional Application No. 60/217,124, which was filed on Jul. 10, 2000, is entitled "Hydration System with Improved Fluid Delivery System," and the complete disclosure of which is hereby incorporated by reference for all purposes.

FIELD OF THE INVENTION

The present invention relates generally to hydration systems, and more particularly to a hydration system with an improved fluid delivery system.

BACKGROUND OF THE INVENTION

Medical research has demonstrated the importance of maintaining adequate hydration while engaging in strenuous physical activities, such as bicycling or mountain climbing. In the not too distant past, participants in such activities carried their water in bottles or canteens from which they drank periodically. More recently, personal hydration systems have been developed which allow users to drink more or less continuously while engaged in sporting or recreational activities. These personal hydration systems typically have a bag-like fluid reservoir that is carried in a back- or waist-mounted pack. A long flexible tube is connected to the reservoir through an exit port at one end and terminates in a mouthpiece at the other end. The tube is long enough to allow the mouthpiece to be carried in the user's mouth to enable the user to draw water from the reservoir at will. Examples of hydration systems and mouthpieces therefore are disclosed in U.S. Pat. Nos. 5,727,714, 5,060,833, 5,085,349, and 6,070,767, the disclosures of which are hereby incorporated by reference.

Although personal hydration systems have proven to be a great advance over traditional water bottles, they do suffer from some drawbacks. One such drawback is inherent in the fact that the mouthpiece is designed to release fluid when external pressure is applied thereto, such as by a user biting down upon the mouthpiece or sucking on the mouthpiece. During normal operation of the hydration system, this bite-activated mouthpiece is a preferred design because it does not require the user's hands to be used to dispense fluid. Instead, the user's hands are able to remain directed to the user's activity, such as biking, climbing, skiing, and the like. However, sometimes it is desirable to prevent the delivery of fluid from the mouthpiece, even if external forces are applied to the mouthpiece. Otherwise, inadvertent dispensing of fluid may occur if the hydration system or other objects are placed on the mouthpiece, if the mouthpiece is stepped or sat upon, or if the mouthpiece strikes objects. Because the mouthpiece remains ready to dispense fluid upon the application of external forces thereto, fluid may be inadvertently dispensed from the reservoir. This unintentional, or inadvertent, dispensing of fluid not only wastes the fluid in the reservoir, but also may damage objects upon which the fluid is dispensed.

SUMMARY OF THE INVENTION

The present invention provides a hydration system with a fluid reservoir and a draining tube extending from the reservoir and terminating at a dispensing end. The system typically includes a mouthpiece in fluid communication with the dispensing end of the drinking tube. In some embodiments, the mouthpiece is a bite-actuated mouthpiece and/or a self-sealing mouthpiece. The hydration system further includes a flow-restricting device that allows the user to selectively restrict the flow of fluid to the mouthpiece of the hydration system, thereby preventing unintentional dispensing of fluid contained within the hydration system's fluid reservoir. In some embodiments, the flow-restricting device includes a body and a rotatable core.

Many other features of the present invention will become manifest to those versed in the art upon making reference to the detailed description which follows and the accompanying sheets of drawings in which preferred embodiments incorporating the principles of this invention are disclosed as illustrative examples only.

BRIEF DESCRIPTION OF THE DRAWINGS

FIG. 8 is a top plan view of the body portion for the flow-restricting device of FIG. 7.

FIG. 9 is a cross-sectional side elevation view of the body portion of FIG. 7 taken along line 9—9 in FIG. 8.

FIG. 10 is a top plan view of another body portion for a flow-restricting device constructed according to the present invention.

FIG. 11 is a cross-sectional side elevation view of the body portion shown in FIG. 10 taken along line 11—11 in FIG. 10.

FIG. 12 is a side elevation view of the core portion shown in FIG. 7

FIG. 13 is a top plan view of the core portion shown in FIG. 7.

FIG. 14 is an isometric view of another core portion for a flow-restricting device constructed according to the present invention.

FIG. 15 is a side elevation view of the core portion shown in FIG. 14.

FIG. 16 is a top plan view of the core portion shown in FIG. 14

FIG. 24 is a side elevation view of a body portion of the flow-restricting device of FIG. 20.

FIG. 25 is a side elevation view of the a variation of the body portion of FIG. 24.

FIG. 26 is a side elevation view of the core portion of the flow-restricting device of FIG. 20.

FIG. 27 is a cross-sectional view of the flow-restricting device shown in FIG. 20 taken along the line 26—26 in FIG. 20.

FIG. 28 is an enlarged detail of a seal between the core portion and the body portion taken along the line 28 in FIG. 27.

DETAILED DESCRIPTION AND BEST MODE OF THE INVENTION

Figure 1:
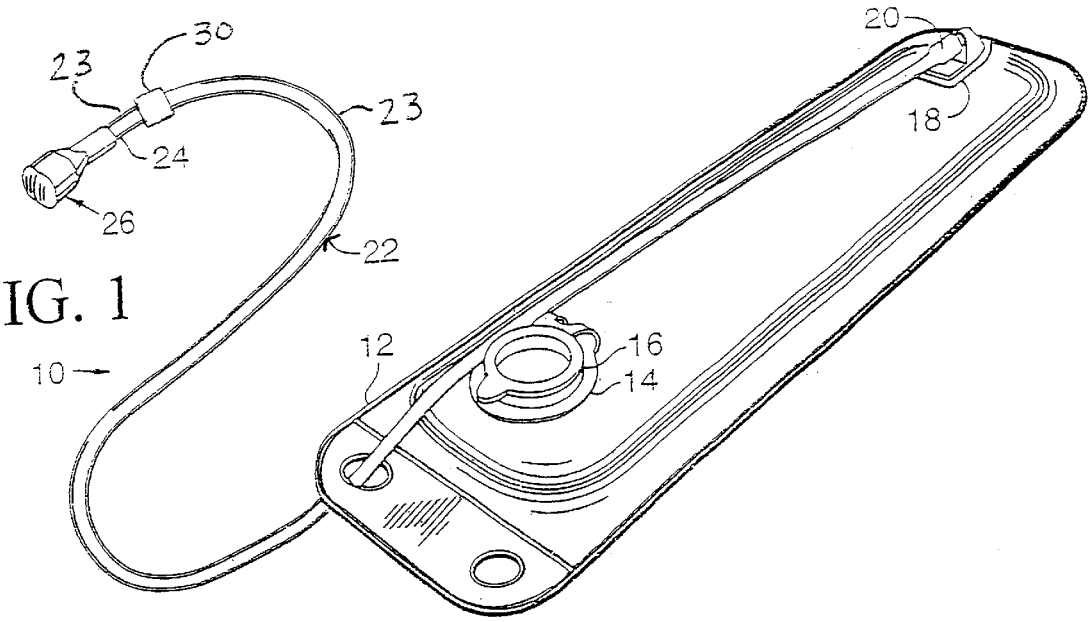
FIG. 1 is an isometric view of a hydration system constructed according to the present invention.
Figure 2:
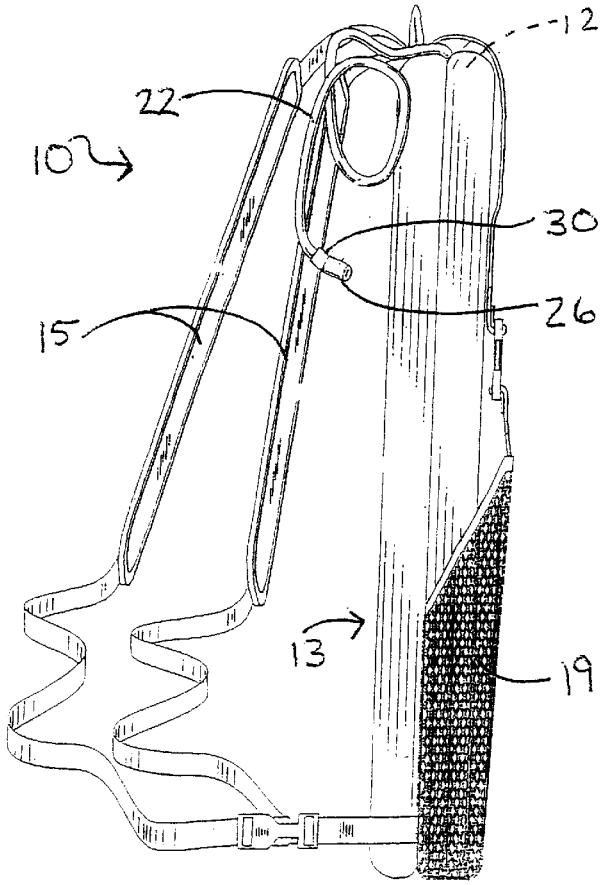
FIG. 2 is a side elevation view of an embodiment of the system of FIG. 1 including a back-mounted pack.
Figure 3:
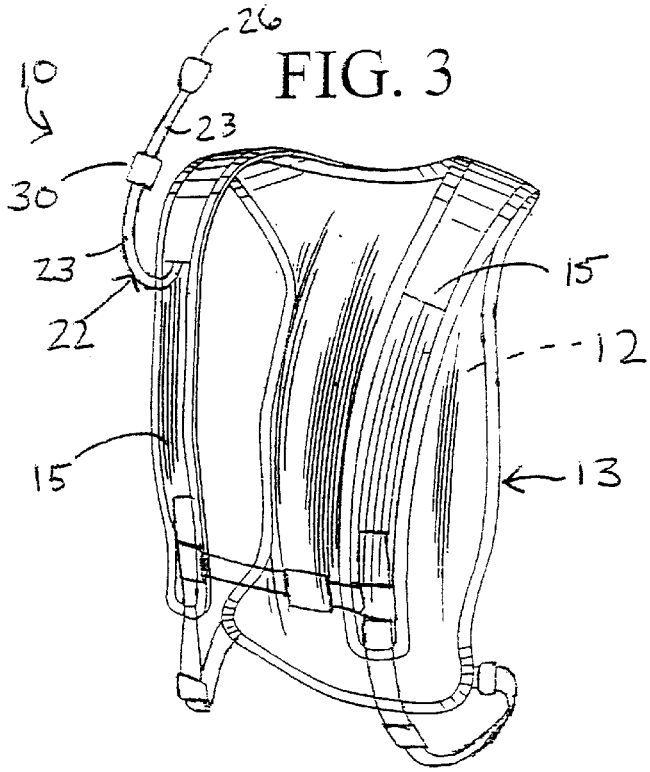
FIG. 3 is a front isometric view of another embodiment of the system of FIG. 1 including a back-mounted pack.
Figure 4:
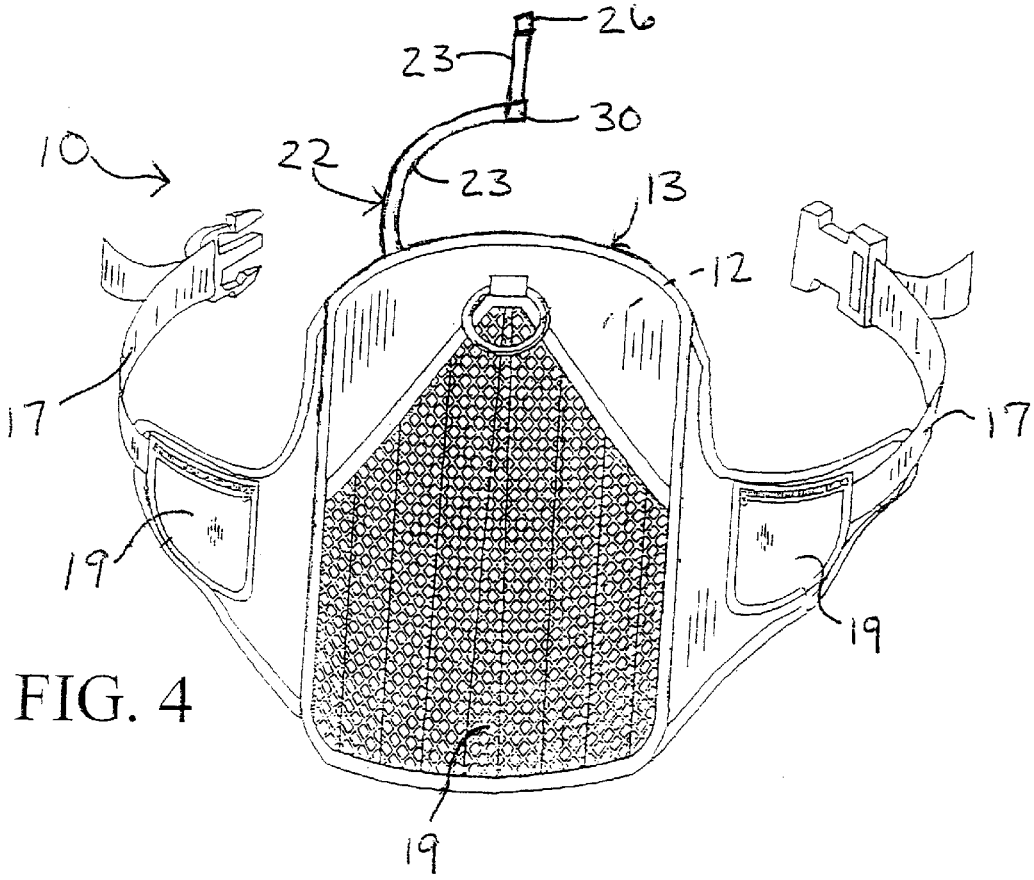
FIG. 4 is an end elevation view of another embodiment of the system of FIG. 1 including a waist-mounted pack.

A personal hydration system is shown generally at 10 in FIG. 1. System 10 includes a fluid reservoir, or bladder, 12 for storing fluid (such as water, sports drinks, juice, etc.). As shown in FIGS. 2–4, system 10 often includes a pack 13 which may house bladder 12. Pack 13 typically is adapted to be worn on a user's body. For example, pack 13 may include at least one shoulder strap 15 for mounting the pack on a user's back or chest, such as shown in FIGS. 2–3. Similarly, the pack may include waist-straps 17 for securing the pack around a user's waist, such as shown in FIG. 4. Pack 13 may be designed to receive only bladder 12, or alternatively, may include one or more pockets 19 for storing additional items. Examples of hydration systems and mouthpieces therefore are disclosed in U.S. Pat. Nos. 5,727,714, 5,060,833, 5,085,349, and 6,070,767, the disclosures of which are hereby incorporated by reference, as well as in copending Provisional Patent Application Serial No. 60/217,124, the disclosure of which is also hereby incorporated by reference. It is within the scope of the invention that hydration system 10 may be formed without a pack.

Bladder 12 is preferably flexible and may vary in shape and size of depending on the volume of fluid to be carried by the user and the shape of pack 13 or other storage container into which the bladder is stored when carried by a user. Bladder 12 includes an input port, such as a sealable filler spout 14 with a cap 16, which may be opened to empty, fill or clean the bladder. Bladder 12 also includes an exit port or output port, 18 onto which one end 20 of a flexible tube, or tube assembly, 22 is mounted. As used herein, the term "tube assembly" may refer to a single length of tubing that defines a fluid conduit for drink fluid drawn from reservoir 12, as well as to a plurality of interconnected lengths of tubing. End 20 may be removably attached to port 18, or may be integrally formed or permanently mounted thereupon.

Tube assembly 22 is of sufficient length to extend from bladder 12 to the user's mouth when the system is worn by the user, such as on the user's back or waist. The other end 24 of tube assembly 22 may be adapted to provide fluid to a user's mouth. Typically, a mouthpiece 26 is coupled with end 24 of tube assembly 22, such that tube assembly 22 is in fluid communication with mouthpiece 26. Mouthpiece 26 may be removable from tube assembly 22 or alternatively may be integrated with tube assembly 22. For example, mouthpiece 26 may simply be the end 24 of tube assembly 22 distal output port 18, the output mount 38 of the subsequently described flow-restricting device, or structure that is removably or permanently attached to end 24. An example of a mouthpiece is a bite-actuated, or mouth-actuated mouthpiece that it is selectively deformed from a closed position, in which fluid is prevented from being dispensed from the mouthpiece, to a dispensing (or open) position, in which the user may draw fluid from the bladder through the tube and mouthpiece, when the user compresses the mouthpiece with the user's teeth or lips. Bite-actuated mouthpieces are often biased or otherwise configured to automatically return to the closed position when a user is not exerting force upon the mouthpiece to configure the mouthpiece to its closed position. Examples of suitable bite-actuated mouthpieces are disclosed in U.S. Pat. Nos. 6,070,767, 5,085,349 and 5,060,833, the complete disclosures of which are hereby incorporated by reference.

Hydration system 10 further includes a flow-restricting device 30 positioned downstream from output port 18 and upstream from mouthpiece 26 or distal end 24 of drinking tube assembly 22. Device 30 may be positioned at any point downstream from reservoir 12. For example, in FIG. 2, device 30 is shown positioned toward end 24 of tube assembly 22. Such a configuration where device 30 extends between and interconnects tube assembly 22 with mouthpiece 26 is referred herein as an end-of-line mounting system. In such a configuration, the mouthpiece may be permanently or removably attached to the device 30. Alternatively, FIGS. 3 and 4 illustrate device 30 positioned within two lengths of tubing 23 forming tube assembly 22. Such a configuration is referred to herein as an in-line configuration. In such an embodiment, mouthpiece 26 may be attached to tube assembly 22 distal device 30, or end 24 of the tube assembly may form the mouthpiece. It should be understood that device 30 is schematically illustrated in FIGS. 1–4, and that mouthpiece 26 has been schematically illustrated in FIG. 4.

Figure 5:
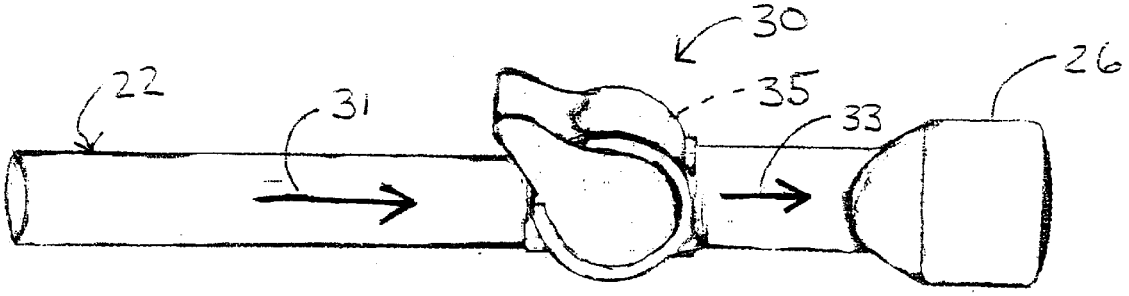
FIG. 5 is a fragmentary isometric view of a flow-restricting device constructed according to the present invention and shown in an open configuration.
Figure 6:
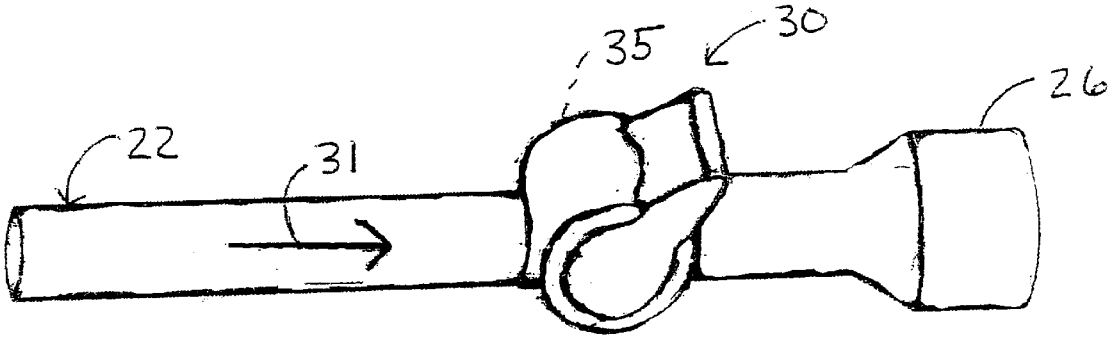
FIG. 6 is a fragmentary isometric view of the flow-restricting device of FIG. 5 in a closed configuration.

Device 30 includes a valve assembly 35 that may be selectively adjusted by a user to prevent fluid in reservoir 12 from flowing through to mouthpiece 26 and to permit fluid in reservoir to flow from the reservoir to mouthpiece 26. For example, device 30 may be selectively positionable by a user between an open configuration (shown in FIGS. 5, 17 and 20), in which fluid may flow through the device, and a closed configuration (shown in FIGS. 6 and 22), in which fluid from the reservoir cannot flow through the device. More particularly, in FIG. 5, device 30 is shown rotated such that fluid may flow from tube assembly 22 to mouthpiece 26, as schematically indicated with arrows 31 and 33. However, in FIG. 6, where device 30 is in a closed configuration, fluid flows from tube assembly 22 to device 30, as shown by arrow 31, but is prevented by device 30 from flowing through the device to mouthpiece 26.

It is within the scope of the invention that device 30 may also be adapted to provide one or more flow configurations between the above-described closed positions and a fully open position. For example, device 30 may be positionable in one or more intermediate flow configurations in which only a portion of the maximum flow available in the open configuration may pass through the device. By providing such intermediate positions, a user may be able to regulate the amount of fluid flow accessible through mouthpiece 26.

Preferably, device 30 is a manually actuated device, which means that a user must apply forces to the device to configure the device between its positions. Similarly, device 30 may be constructed to remain in a user-selected position within the device's defined range of positions even after the user-applied force is removed. For example, once the user configures the device to its open position, the device may remain in that position until the user applies sufficient force to configure the device to a different position. A benefit of such a construction is that the user does not have to apply constant pressure or force on the device to retain the device in a particular user-selected position. However, it is within the scope of the invention that device 30 may include a biasing assembly or mechanism, such as one or more springs, deflectable members, or elastomeric members, that automatically return the valve to a particular position, such as the closed position, upon removal of user applied forces. A benefit of such a configuration is that the user does not have to remember to return the device to the resting, or unactuated, position.

Device 30 may be permanently attached to tube assembly 22 and/or mouthpiece 26, such as being integrally formed therewith or permanently attached thereto, such as with an adhesive, weld or other permanent fastening mechanism. By "permanently attached," it is meant that the attached structure are not readily removable from each other without destroying at least a portion of one the attached structures. Alternatively, device 30 may be a modular device that is releasably attached to tube assembly 22 and/or mouthpiece 26. By "releasably attached," it is meant that the device may be repeatedly removed from attachment to the corresponding structure and then reattached thereto. A benefit of a modular device is that the device may be removed from the hydration system, such as for cleaning, replacement, upgrades, etc.

Figure 7:
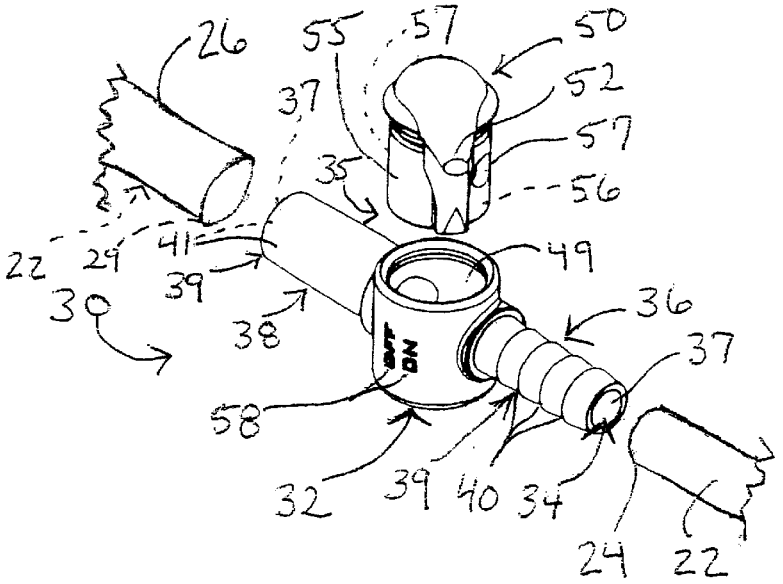
FIG. 7 is an exploded isometric view of the flow-restricting device of FIGS. 5 and 6.

In FIG. 7, an exploded view of an illustrative example of a flow-restricting device constructed according to the present invention is shown. As shown, device 30 includes a base, or body, 32 that defines a conduit or passageway 34 through which fluid may flow. Body 32 includes inlet and outlet portions 36 and 38, which may also be referred to as input and output mounts. Mounts 36 and 38 are adapted to couple the device to, and establish fluid communication with, the fluid reservoir and the mouthpiece or distal end of drinking tube assembly 22. Input and output mounts 36 and 38 are hollow, with each mount defining an end 37 of passageway 34, through which drink fluid may flow from reservoir 12 to mouthpiece 26 when the flow-restricting device is in its open configuration.

Input mount 36 is generally configured to be coupled with tube assembly 22 and receives fluid flowing from reservoir 12. Output mount 38 is oriented downstream of input mount 36 and may be configured to dispense fluid into a user's mouth. For example, output mount 38 may be coupled with a selected one of tube 22 and/or mouthpiece 26. Tube 22 may have a mouthpiece attached further downstream from device 30. Alternatively, output mount 38 may include an integrated mouthpiece configured to permit a user to directly dispense liquid from output mount 38 into the user's mouth.

Input mount 36 includes mount structure 39 that is adapted to couple the mount to tube assembly 22. Mount structure 39 includes any suitable structure to couple the input mount and the corresponding end of tube assembly 22. In FIGS. 7–9, this end of the tube assembly is indicated at 25. For example, in FIG. 6, input mount 36 includes mount structure 39 in the form of barbs or ribs 40 that are sized to be inserted within an end of tube assembly 22. The number of barbs on input mount 36 may vary, such as depending upon the length of the mount, the desired force required to remove tube assembly 22, etc. Although only three barbs are shown in FIGS. 7–9, it should be understood that any number of barbs may be used to restrain tube 22 on input mount 36. It is also within the scope of the invention that input mount 36 may be formed with out ribs or barbs, in which case mount structure 39 may be a friction fit between the end of tube 22 and input mount 36. Further examples of suitable mount structure 39 include clamps or ties that bind the end of tubing onto input mount 36, and connectors that extend between the end of tubing and input mount 36. It should be understood that input mount 36 may be received at least partially into end 27, end 27 may be received at least partially into input mount 36, or end 27 and mount 36 may be retained by mount structure 39 in an abutting relationship with each other.

In embodiments of the invention where out put mount 38 is adapted to be releasably coupled to a mouthpiece or another portion of tube assembly 22, output mount 38 also includes mount structure 41. The shape, size and configuration of mount structure 41 may be the same as mount structure 39 or may vary, such as due to differences in the sizes, shapes and/or materials of construction of end 27 and mouthpiece 26 and/or the corresponding end of tubing 23 on which output mount 38 is coupled. In FIG. 7, output mount 38 is shown being adapted to couple to a mouthpiece 26 that is inserted at least partially over output mount 38. Alternatively, and as indicated in dashed lines in FIG. 7, mount 38 may be described as being adapted to be inserted at least partially into an end 29 of a larger diameter tube 23 or to be receive at least partially therein end 29.

It should be understood that the above description and associated drawings are intended to provide illustrative examples of suitable structures for mounts 36 and 38. In embodiments of body 32 in which a mount is configured to receive internally the end of tube 23 or mouthpiece 26, the mount may be described as including a sleeve 44 into which the tube and/or mouthpiece is at least partially received. It is within the scope of the invention that mounts 36 and 38 may have the same or similar configurations and/or mount structures. For example, in FIGS. 10 and 11, body portion 32 is shown having input and output mounts 36 and 38 that both include mount structures 39 and 41 in the form of barbs 40, and which therefore are both adapted to be at least partially received within the corresponding ends of tubes or mouthpieces with which device 30 is fluidly connected. Such a configuration may be used in an in-line configuration to couple two lengths of tubing, or in an end-of-line configuration to couple the device to a length of tubing and a mouthpiece.

It is also within the scope of the invention that at least one of the mounts may include a first portion that is at least partially received within a tube 23 and/or mouthpiece 26, and a second portion that extends radially outward form the first portion and which extends at least partially over the tube and/or mouthpiece to essentially sandwich the portion of the tube or mouthpiece between concentric portions of the mount. An example of such a configuration is schematically illustrated in dashed lines in FIG. 11 with respect to mount 36, but it should be understood that either or both of the mounts may have such a configuration.

The length of mounts 36 and 38 may vary and are not necessarily equal. Because at least one of the mounts is typically coupled to a flexible structure, such as tube 23, it may be desirable for the corresponding mount to be of sufficient length to provide a leverage point for use when a user grasps the device and tries to manipulate the device within its range of configurations using one hand.

Referring back to FIGS. 7 and 8, it can be seen that body 32 includes a chamber 49 that is adapted to receive a rotatable core 50. As shown, chamber 49 is generally cylindrical and separates input mount 36 from output mount 38. Core 50 is adapted to obstruct passageway 34 when core 50 is positioned in a closed configuration. Such an obstruction prevents fluid from flowing from input mount 36 to output mount 38 and therefore prevents fluid from flowing through a downstream mouthpiece. Alternatively, core 50 may be positioned in an open configuration such that conduit 34 is generally unobstructed such that fluid is able to flow from input mount 36 to output mount 38.

Core 50, as shown in FIGS. 7 and 12, includes a user-manipulable portion or handle 52 that the user may grasp and exert user-applied forces upon to selectively position core 50 in an open or closed configuration. Handle 52 is affixed to core 50, such that rotation of handle 52 results in the corresponding rotation of core 50. Handle 52 may also be used when inserting or removing core 50 from body 32, as discussed further below. Moreover, handle 52 may be textured, shaped or otherwise configured to provide an enhanced gripping surface.

Core 50 further includes a drum portion 55, which is configured to be received within chamber 49 of body 32. Drum portion 55 includes a drum conduit 56 that defines a portion of fluid conduit 34 when the flow-restricting device is in its open configuration. Conduit 56 includes openings 57 that are in fluid communication with passage 34 when the device is in its open configuration, but at least one of which is not in fluid communication with the passageway when the device is in its closed configuration. In other words, drink fluid from reservoir 12 may not pass through at least one of the openings 57 in drum portion 55 when the flow-restricting device is in its closed position. When both openings 47 are at least partially aligned with passageway 34 so as to be in fluid communication therewith, then drink fluid may flow from reservoir 12, through passageway 34, including drum conduit 56, and to mouthpiece 26.

The amount of drink fluid that may flow through drum portion 55 is dependent, at least in part, upon the rotational alignment with openings 57 with passageway 34. When the two are fully aligned, then device 30 is in its fully open configuration. When at least one of the openings is sufficiently unaligned with passageway 34 so as to not be in fluid communication therewith, then the device is in its closed configuration. When at least one of the openings is only partially aligned, then the device is an in intermediate open configuration. It should be understood that the degree of rotation or movement of core 50 between the closed configuration and an open configuration may vary depending upon the shape and angular orientation of body 32.

Figure 18:
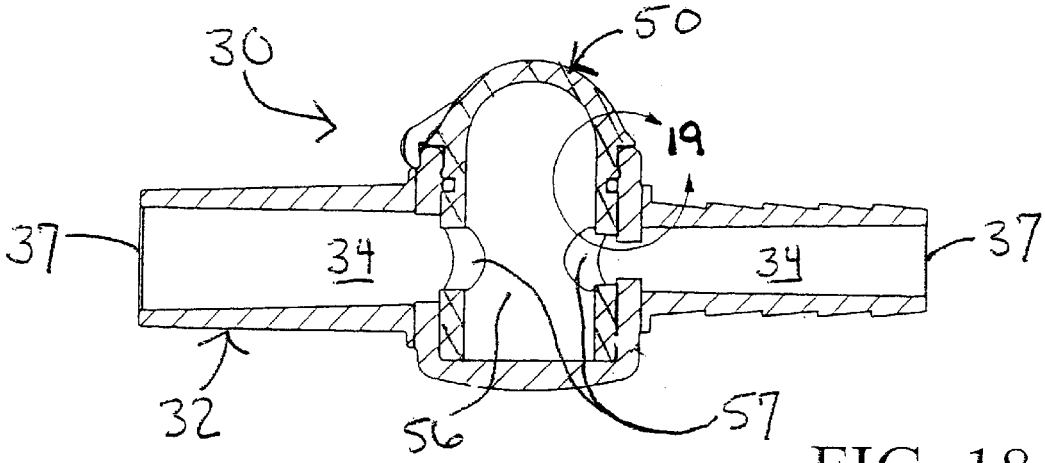
FIG. 18 is a cross-sectional view of the flow-restricting device shown in FIG. 17 taken along the line 18—18 in FIG. 17.
Figure 19:
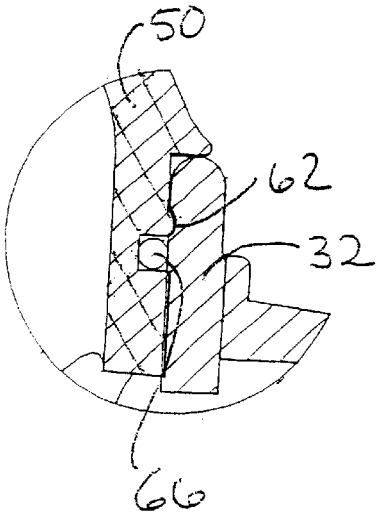
FIG. 19 is an enlarged detail of the seal between the core portion and the body portion of the device of FIG. 17 taken along the line 19 in FIG. 18.

Core 50 may be permanently mounted within body 32, or alternatively may be releasably coupled to the body. A benefit of a removable core is that the core may be removed to clean, lubricate and/or repair the device. Lubricating material, such as silicone grease, may be applied on the inside of chamber 49 to provide easier rotation of core 50 within body 32, and in embodiments of device 30 that include removable cores 50, to facilitate easier insertion and removal of the core from the body. Core 50 may additionally or alternatively include gaskets, o-lings, or other suitable sealing structures 66 to provide (or assist in the provision of) a fluid-tight seal between core 50 and body 32. An illustrative example of such a sealing structure 66 is shown in FIGS. 18 and 19. The sides of chamber 49 may also be polished to provide a mirror finish to improve the seal.

In FIGS. 12 and 14–15, it can be seen that core 50 may include a rim or sealing ring 62, which may provide a fluid-tight seal between core 50 and body 32. In such an embodiment, sealing ring 62 is adapted to prevent drink fluid from leaking between portion 55 and chamber 49. Sealing ring 62 may additionally or alternatively be described as a retainer, or detent structure that retains core 50 within body 32. Sealing ring 62 may provide a snap-fit engagement with the corresponding portion of body 32 when the core snaps into chamber 49 of body 32. In embodiments of device 30, in which core 50 is removable from base portion 32, core 50 may be removed from body 32 by applying pressure to core 50 in the opposite direction of insertion.

As described above, rotation of handle 52 positions apertures 57 in the various configurations. Device 30 may include indicia 58 that demarcate one or more of these configurations. For example, in FIG. 7, base portion 32 includes indicia 58 in the form of the words "ON" and "OFF." A position indicator may be provided that demarcates these positions. For example, and as shown in FIG. 7, handle 52 acts as a position indicator as it rotates core 50 between different configurations. Thus, if core 50 is inserted within chamber 49 of device 30 as shown in FIG. 7, the valve will be in an open configuration since opening 57 will be substantially aligned with passageway 34. If handle 52 is rotated towards the "OFF" designation, opening 57 will be rotated such that there is no fluid communication between passageway 34 and opening 57. The fluid will not be able to flow between input mount 36 and output mount 38. Although "ON" and "OFF" are illustrated in FIG. 7, any other suitable indicia may be used. For example, symbols or graphical indicia may be used to indicate the amount of flow in a particular configuration.

Device 30 may additionally or alternatively include detents or other stop structures that define tactically and/or audibly, one or more of the possible flow configurations. For example, in FIGS. 8 and 10, illustrative examples of detents 59 are shown positioned along the outer rim of body 32. When core 50 passes over detents 59, the position of core 50 relative to body 32 may be identified by feel as the core engages the detents. Additionally, there may be an audible sound, such as a click, as the core engages the detents. Thus, the position of core 50 and the configuration of device 30 may be identified by sight, sound and/or feel. A benefit of tactile and/or audible indicators is that a user does not have to look at device 30 to know the configuration of the device. It should be understood that detents 59 may merely provide tactile or audible indications of the relative configuration of device 30. However, it is also within the scope of the invention that detents 59 are adapted to at least partially retain the device in a particular configuration, such as by requiring a comparatively greater force to reconfigure the device from the particular configuration than when the device is not in a configuration defined by a detent. It should also be understood that device 30 may be formed without indicia 58 and/or detents 59.

Figure 17:
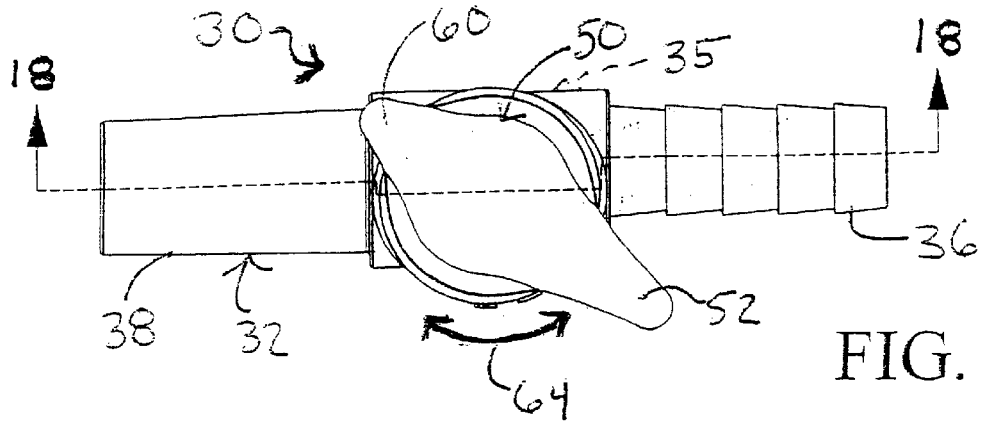
FIG. 17 is a top plan view of the core portion of FIGS. 14–16 mounted on the body portion of FIGS. 8 and 9.

In FIGS. 14–16, another suitable configuration for core 50 is shown. As shown, handle 52 includes a handle extension 60 that projects beyond drum portion 55 from the side of core 50 generally opposite handle 52. By providing generally opposed structures that extend radially outward from drum portion 55, a user may more easily rotate core 50 within base portion 32, compared to a similarly constructed core that does not include extension 60. A user may apply concurrent pressure to both handle 52 and extension 60 to effect the rotation of core 50. Extension 60 may also be used as a position indicator by aligning with corresponding indicia 58 on body 32. FIGS. 17–19, the core of FIGS. 14–16 is shown mounted on the body shown in FIGS. 7–9.

FIGS. 5–19 have generally illustrated a device where the fluid follows through passageway 34 along a generally linear flow path. It is within the scope of the present invention that the base portion may define curved or otherwise angled flow paths. For example, it may be desirable for the input and output mounts 36 and 38 to extend at right, or other selected, angles to each other to position a mouthpiece or length of tubing at a desired orientation for drinking. An example of a flow-restricting device with such a configuration is shown in FIGS. 20–28. As shown, the angle between mounts 36 and 38 is approximately 90°. It is within the scope of the invention that other angles may be used, such as angles in the range of 30° and 150°, and angles in the range of 45° and 135°.

In particular, FIGS. 20–23 illustrate an embodiment of a flow-restricting device 30' that has a body 32 that forms a right-angle passageway 34 through which drink fluid may selectively flow, depending upon the configuration of the device. Unless otherwise indicated herein, device 30' may include the same elements, subelements and variations described, illustrated and/or incorporated above with respect to device 30. For example, input mount 36 is adapted to be coupled to an end of tube assembly 22, and output mount 38 is adapted to form mouthpiece 26, be coupled to another length of tubing 23 in tube assembly 22, or to be coupled to a mouthpiece 26. Similarly, the mounts may include any suitable mounting structures 39 and 41, such as those described above.

Figure 20:
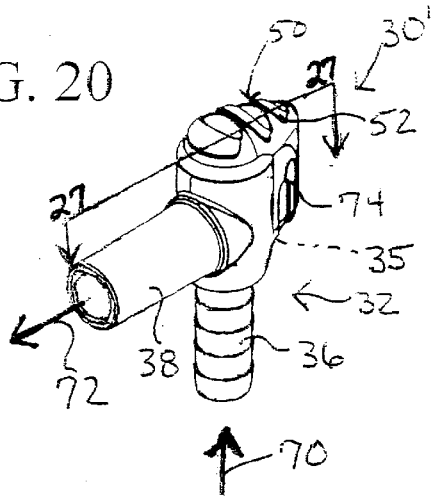
FIG. 20 is an isometric view of another flow-restricting device constructed according to the present invention and shown in an open configuration.
Figure 21:
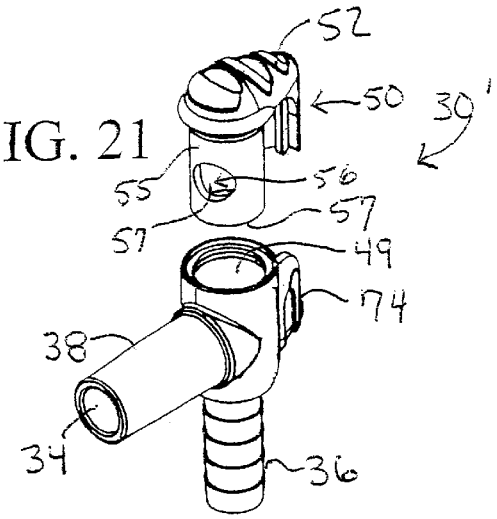
FIG. 21 is an exploded view of the flow-restricting device of FIG. 20.
Figure 22:
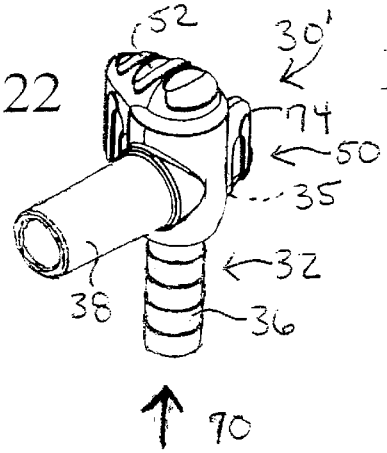
FIG. 22 is an isometric view of the flow-restricting device of FIG. 20 in a closed configuration.
Figure 23:
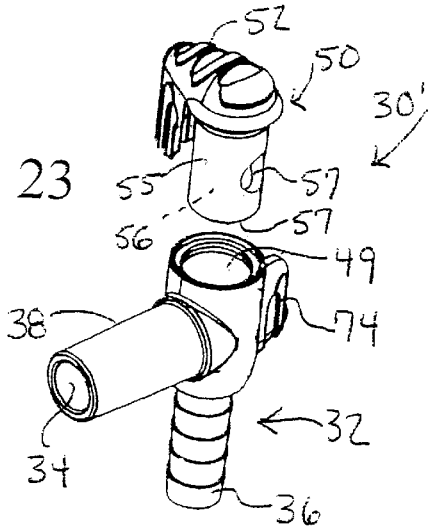
FIG. 23 is an exploded view of the flow-restricting device of FIG. 22.

In FIGS. 20 and 21, device 30' (and core 50) is shown in an open configuration, in which drink fluid from the hydration system's reservoir may flow through the device as schematically indicated in FIG. 20 by arrows 70 and 72. In FIGS. 22 and 23, device 30' (and core 50) is shown in a closed configuration, in which drink fluid from the hydration system's reservoir cannot flow through the device, as indicated schematically in FIG. 22 with the single arrow 70. As perhaps best seen in FIGS. 21 and 23, drum portion 55 still includes a drum conduit 56 with openings 57. However, in the illustrated embodiment, openings 57 extend generally transverse to each other, instead of the generally parallel configuration shown in connection with device 30.

Device 30' also demonstrates another suitable handle configuration that may be used with any of the embodiments of the flow-restricting device constructed according to the present invention. As shown, handle 52 of core 50 is configured to physically engage a mating structure 74 on body 32. Thus, when core 50 is rotated to the open configuration, handle 52 of core 50 mates with mating structure 74 to form a generally streamlined composite projection.

FIGS. 24 and 25 are exploded views of a base where the input mount 36 is displaced at an angle from the output mount. As described above, the input and output mounts may be of any suitable configurations that engage tube assembly 22 and/or mouthpiece 26. For example, and as illustrated in FIG. 24, input mount 36 may include barbs 40, which are adapted to engage the inside of an end of a tube 23 of tube assembly 22. Output mount 38 may include a sleeve as shown, or any of the other structures and configurations described, illustrated and incorporated herein, such as the barbed configuration shown in FIG. 25.

FIG. 27 further illustrates a cross-sectional view of device 30 in an open configuration. As shown, opening 57 of core 50 is substantially aligned with passageway 34 defined by body 32. Fluid may directly flow from input mount 36 to output mount 38 through passageway 34, which includes drum conduit 56. FIG. 28 shows a portion of the seal between core 50 and body 32. A sealing ring 62, as described above, may prevent core 50 from unintentionally being released from body 32. An sealing structure 66 may provide or enhance a water-tight seal between the core and body.

Industrial Applicability

The invented hydration systems are applicable to the hydration industry, and are specifically applicable to personal hydration systems, such as those worn by users in a variety of sporting, recreational, hunting, industrial, military and law enforcement applications.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower or equal in scope to the original claims, are also regarded as included within the subject matter of the inventions of the present disclosure.

We claim:

1. A personal hydration system, comprising:

a fluid reservoir configured to store drink fluid;

a flexible tube assembly coupled to the reservoir and adapted to receive drink fluid from the reservoir; and a flow-restricting device, comprising a body having an input mount and an output mount and a fluid passageway extending therebetween, wherein the input mount is configured to be coupled to the tube assembly to receive drink fluid therefrom, and a core rotationally coupled to the body and including a drum that extends into the passageway, wherein the drum includes a drum conduit with openings, and further wherein upon rotation of the core, the flow-restricting device is selectively configured between a defined range of configurations that include an open configuration, in which the drum conduit forms a portion of the passageway and drink fluid may flow from the reservoir, through the passageway and through the output mount, and a closed configuration, in which the drum obstructs the passageway and drink fluid cannot flow through the device.

2. The system of claim 1, wherein the hydration system further includes a pack adapted to receive the fluid reservoir.

3. The system of claim 2, wherein the pack includes at least one shoulder strap.

4. The system of claim 2, wherein the pack includes at least one waist strap.

5. The system of claim 1, wherein the core is removably attached to the body.

6. The system of claim 1, wherein the output mount is adapted to be coupled to a mouthpiece.

7. The system of claim 6, wherein the mouthpiece is a self-sealing mouthpiece.

8. The system of claim 7, wherein the mouthpiece is a bite-actuated mouthpiece.

9. The system of claim 1, wherein the output mount is adapted to be coupled to a downstream portion of the tube assembly.

10. The system of claim 1, wherein at least one of the input mount and the output mount are adapted to be at least partially inserted into an end of the tube assembly.

11. The system of claim 10, wherein both of the input mount and the output mount are adapted to be at least partially inserted into ends of the tube assembly.

12. The system of claim 1, wherein at least one of the input mount and the output mount includes mounting structure in the form of at least one projecting barb.

13. The system of claim 1, wherein at least one of the input mount and the output mount includes mounting structure in the form of a sleeve into which at least one of an end of the tube assembly and an end of a mouthpiece are adapted to be received.

14. The system of claim 1, wherein at least one of the input mount and the output mount includes mounting structure in the form of a sleeve over which at least one of an end of the tube assembly and an end of a mouthpiece are adapted to be received.

15. The system of claim 1, wherein the output mount extends at an angle of approximately 180 degrees relative to the input mount.

16. The system of claim 1, wherein the output mount extends at an angle in the range of 30° and 150° relative to the input mount.

17. The system of claim 16, wherein the angle is approximately 90 degrees.

18. The system of claim 1, wherein the core is removably coupled to the body.

19. The system of claim 18, wherein the core includes a rim that is adapted to engage the body in a snap-fit configuration.

20. The system of claim 1, wherein the core includes a sealing structure configured to engage the body to form a fluid tight seal between the core and the body.

21. A personal hydration system, comprising:

a fluid reservoir adapted to receive a volume of drink fluid and including an exit port through which drink fluid may be dispensed from the reservoir;

a tube assembly that includes at least one flexible tube coupled to the output port and adapted to receive drink fluid therefrom; and a flow-restricting device comprising:

a body defining a fluid passageway and including an input mount and an output mount, wherein the input mount is removably coupled to the tube assembly and the output mount is coupled to a selected one of a second flexible tube and a mouthpiece; and a core configured to be removably coupled to the body, wherein the core includes a fluid conduit extending through the core and a handle, wherein the handle is adapted to configure the core between an open configuration where the fluid conduit is in fluid communication with the passageway and drink fluid may flow from the reservoir through the flow-restricting device, and a closed configuration, in which the core obstructs the passageway and drink fluid cannot flow from the reservoir through the flow-restricting device.

22. The system of claim 21, wherein the hydration system further includes a pack adapted to receive the reservoir.

23. The system of claim 21, wherein in output mount is removably coupled to the selected one of the second flexible tube and the mouthpiece.

24. The system of claim 21, wherein the output port includes an integral mouthpiece.

25. The system of claim 21, wherein the core is rotatably coupled to the body.

26. The system of claim 21, wherein in the open configuration, the fluid conduit defines a portion of the fluid passageway.

27. The system of claim 21, wherein the core further includes a sealing ring that engages the body in a snap-fit configuration.

28. The system of claim 21, wherein at least one of the input mount and the output mount are adapted to be at least partially inserted into an end of the tube assembly.

29. The system of claim 28, wherein both of the input mount and the output mount are adapted to be at least partially inserted into ends of the tube assembly.

30. The system of claim 21, wherein at least one of the input mount and the output mount includes mounting structure in the form of at least one projecting barb.

31. The system of claim 21, wherein at least one of the input mount and the output mount includes mounting structure in the form of a sleeve into which at least one of an end of the tube assembly and an end of a mouthpiece are adapted to be received.

32. The system of claim 21, wherein at least one of the input mount and the output mount includes mounting structure in the form of a sleeve over which at least one of an end of the tube assembly and an end of a mouthpiece are adapted to be received.

33. The system of claim 21, wherein the output mount extends at an angle of approximately 180 degrees relative to the input mount.

34. The system of claim 21, wherein the output mount extends at an angle in the range of 30° and 150° relative to the input mount.

35. The system of claim 34, wherein the angle is approximately 90 degrees.

36. A personal hydration system comprising:

a fluid reservoir configured to store drink fluid and having an output port through which drink fluid may be dispensed from the reservoir;

a tube assembly extending from the output port of the fluid reservoir and adapted to receive drink fluid therefrom; and a manually operable flow-restricting device coupled with the tube assembly and configured to selectively regulate the flow of drink fluid through the tube assembly, the device comprising:

a body, and a rotatable core, wherein the core is attached to the body and is configured to rotate to a plurality of positions within the body to selectively restrict fluid flow.

37. The personal hydration system of claim 36, further comprising a pack configured to receive the fluid reservoir.

38. The system of claim 36, wherein the body further includes an input mount attached to the tube and an output mount attached to a mouthpiece.

39. The system of claim 38, wherein the core is selectably rotated between an open configuration where there is fluid communication between the input mount and the output mount and a closed configuration where there is no fluid communication between the input mount and the output mount.

40. The system of claim 36, wherein the tube assembly includes a plurality of lengths of tubing, and further wherein the flow-restricting device is coupled between and in fluid communication first and second ones of the plurality of lengths of tubing.

41. The system of claim 36, wherein the flow-restricting device further includes at least one tactile position indicator.

42. The system of claim 36, wherein the flow-restricting device further includes at least one audible position indicator.

* * * * *

UNITED STATES PATENT AND TRADEMARK OFFICE

CERTIFICATE OF CORRECTION

PATENT NO. : 6,497,348 B2
DATED : December 24, 2002
INVENTOR(S) : Barley A. Forsman and Robert Choi It is certified that error appears in the above-identified patent and that said Letters Patent is hereby corrected as shown below:

Column 12,
Line 8, after "claim 21, wherein," please delete "in" and insert -- the -- therefor.

Column 13,
Line 1, after "the core is" please delete "selectably" and insert -- selectively -- therefor.

Column 14,
Line 1, after "communication" please insert -- with --.

Signed and Sealed this

Eleventh Day of March, 2003

JAMES E. ROGAN
*Director of the United States Patent and Trademark Office*